US005081925A

United States Patent [19]

Höll et al.

[11] Patent Number: 5,081,925

[45] Date of Patent: Jan. 21, 1992

[54] SELECTIVE DRIVE FOR A DAMPING UNIT METERING ROLLER IN AN OFFSET PRINTING PRESS

[75] Inventors: Roland Höll, Weiterstadt; Herbert Rebel, Rodgau; Peter Hummel, Offenbach am Main, all of Fed. Rep. of Germany

[73] Assignee: MAN Roland Druckmaschinen AG, Fed. Rep. of Germany

[21] Appl. No.: 554,150

[22] Filed: Jul. 16, 1990

[30] Foreign Application Priority Data

Jul. 14, 1989 [DE] Fed. Rep. of Germany ..... 3923350

[51] Int. Cl.[5] ..... B41L 25/00

[52] U.S. Cl. ..... 101/148; 101/350; 101/208

[58] Field of Search ..... 101/147, 148, 349, 350, 101/351, 206, 207, 208

[56] References Cited

U.S. PATENT DOCUMENTS

| | | | |
|---|---|---|---|
| 2,302,490 | 11/1942 | Curtis | 101/148 |
| 3,749,011 | 7/1973 | Abendroth | 101/148 |
| 3,911,815 | 10/1975 | Banter | 101/148 |
| 4,440,081 | 4/1984 | Beisel | 101/148 |
| 4,597,329 | 7/1986 | Lembens | 101/350 |
| 4,676,156 | 6/1987 | Aylor et al. | 101/148 |
| 4,922,818 | 5/1990 | Junghans | 101/148 |
| 4,960,051 | 10/1990 | Ohta et al. | 101/349 |

FOREIGN PATENT DOCUMENTS 3623590 6/1988 Fed. Rep. of Germany .

*Primary Examiner*—Edgar S. Burr
*Assistant Examiner*—Christopher A. Bennett
*Attorney, Agent, or Firm*—Leydig, Voit & Mayer

[57] ABSTRACT

A selective drive for a metering roller in a damping unit of an offset printing press which enables the metering roller to be driven by the damping fluid fountain roller without peripheral slip during the joint washing of the damping unit and inking unit. The gearwheel drive producing the peripheral slip can be selectively brought into and out of operation by the meshing of two intermediate gears being interrupted and restored by a lever which carries the metering roller and one intermediate gear being pivoted by an actuating cylinder around the axis of the damping unit fountain or ductor roller.

2 Claims, 3 Drawing Sheets

SELECTIVE DRIVE FOR A DAMPING UNIT METERING ROLLER IN AN OFFSET PRINTING PRESS

FIELD OF THE INVENTION

The present invention relates generally to damping units in offset printing presses and more particularly concerns a device for selectively driving a damping unit metering roller in such presses.

BACKGROUND OF THE INVENTION

Generally, a damping unit of an offset printing press as disclosed in DE-PS 3 623 590 includes a damping fluid ductor roller which transfers damping fluid from a fountain or trough to an inking roller and a metering roller which engages the fountain or ductor roller to regulate the thickness of the damping fluid. As is the normal practice, the ductor roller and the metering roller are driven independently of the press by a separate variable-speed geared motor by way of a clutch, a first intermediate gear and a driven gear, the driven gear being securely disposed on the journal of the damping fluid ductor roller. Another intermediate gear provides an automatic drive of the metering roller by way of a second driven gear either synchronously, without peripheral slip, or, with an altered transmission ratio, asynchronously, with slip, with respect to the ductor roller. When the damping and inking unit are washed together in a conventional manner as disclosed for example, from DE-OS 3 641 013, the drive with slip presents a problem because the damping fluid fountain roller and the metering roller run with peripheral slip unless disengaged from one another, so that since they run at different circumferential speeds the rollers could be damaged during washing. If the metering roller is disengaged from the damping unit fountain roller, the metering roller then has to be washed manually.

OBJECT AND SUMMARY OF THE INVENTION

It is the primary object of the invention for the metering roller to be driven off the damping unit ductor roller solely by friction when the damping unit and inking unit are washed together.

According to the present invention, a selective drive is provided for a damping unit of an offset printing press comprising a damping fluid fountain or ductor roller and a metering roller mounted for rotation by journals disposed in levers such that the metering roller is pivotable around the axis of the fountain or ductor roller. The ductor roller and the metering roller are positively driven independently of the press by a variable-speed geared motor through a series of gears. The lever is connected to an actuating cylinder to pivot the metering roller and an intermediate gear around the axis of the ductor roller to selectively disengage the positive drive of the metering roller such that the metering roller is then frictionally driven by the ductor roller.

The advantage of the invention is that a common washing of the damping fluid fountain roller, metering roller and the inking roller of the damping unit and of the rollers of the inking unit coupled by way of a bridge roller can be effected by friction without slip while the positive gearwheel drive of the damping unit is out of engagement. This position is also suitable as a varnishing position. For example, when the intermediate transmission between the metering roller and the damping unit fountain roller is inoperative, pre-metered varnish can be applied continuously with metering in a final working step between the metering roller and the damping unit ductor roller. In this instance, an intermediate roller of the inking unit is generally moved out of engagement with the ink applicator roller. If required, the metering roller can also be disengaged as well so that a two-roller damping or varnishing unit is provided.

These and other features and advantages of the invention will become more apparent from the following detailed description when taken in conjunction with the accompanying drawings.

While the invention will be described and disclosed in connection with certain preferred embodiments and procedures, it is not intended to limit the invention to those specific embodiments. Rather, it is intended to cover all such alternative embodiments and modifications as fall within the spirit and scope of the invention.

DETAILED DESCRIPTION OF THE PREFERRED EMBODIMENTS

Figure 1:
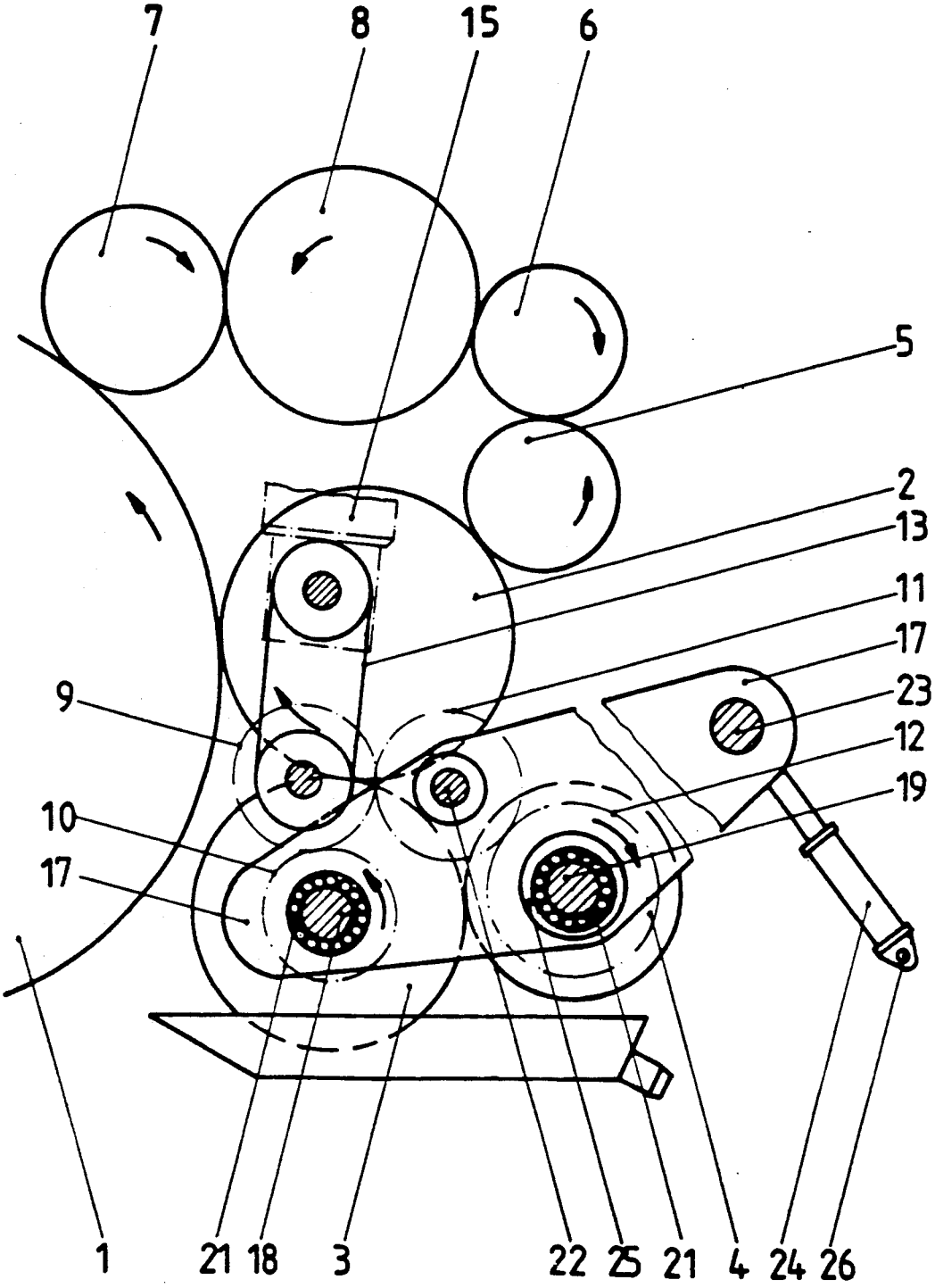
FIG. 1 is a diagrammatic side view of a device in an offset printing press for driving a damping unit, a positive drive between the damping fluid fountain roller and the metering roller being provided by a geared transmission with peripheral slip.

Turning now to the drawings, FIG. 1 shows a damping and inking unit for an offset printing press. The damping unit conveys damping fluid from a damping fluid trough by way of a fountain or ductor roller 3 and of an inking roller 2 directly to the printing plate of a plate cylinder 1. The plate cylinder 1 is mounted by means of journals at both ends in side walls 16 in the printing press. The plate cylinder journals are in a conventional manner known in the art and thus not shown in further detail, driven off the main drive of the press by gears disposed outside one side wall.

The thickness of the damping fluid is adjusted by means of a metering roller 4. The metering roller 4 is mounted at both ends in levers 17 and 20 pivotable around the axis of the fountain roller 3. Thus, it will be seen that the damping unit comprises rollers 2, 3, and 4 which convey the damping liquid to the plate of the cylinder 1 over a very short path so that the evaporation of damping agent is reduced.

Figure 2:
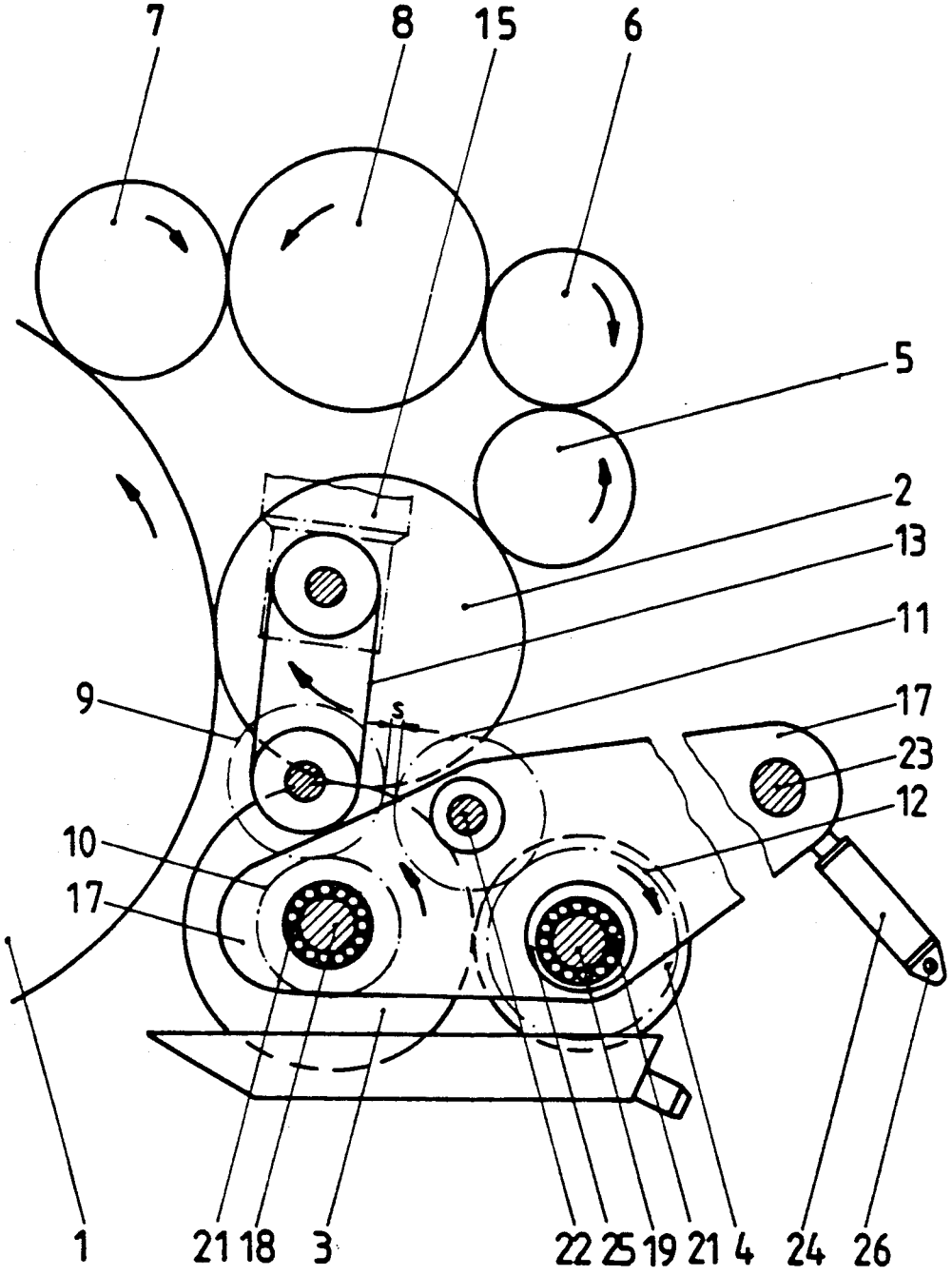
FIG. 2 shows the device of FIG. 1 but with the positive drive disengaged and a friction drive of the metering roller by the damping unit fountain roller.

The present invention provides a selective drive for a damping unit which can be used in conjunction with various conventional inking units in an offset printing press. One such inking unit, as shown in FIG. 2, includes two resiliently covered intermediate rollers 5 and 6 which connect the first ink spreader 8 of an inking unit to the inking roller 2. At least one of the intermediate rollers 5, 6 is adapted to be connected to and disconnected from the ink feed and/or the damping agent feed by conventional means (now shown). An inking roller 7 is also provided. Alternatively, the inking roller 2 can be connected in a conventional manner by just a single resiliently covered intermediate roller to the inking unit and then to the first inking roller. Additionally, the metering roller 4 can have its between-axes distance from the damping fluid fountain roller 3 adjusted in a conventional manner by the rotation of eccentric linings (not shown). It will be further understood that a double eccentric mounting is also possible so that the metering roller can be moved into and out of an adjustable engagement with the fountain roller 3 by means of hand levers or the like or by means of actuating cylinders or the like.

Another conventional and generally known feature not shown in the drawings provides for means, such as a mounting of the inking roller 2 in pivoted levers or in eccentric bearings, to adjust the contact pressure between the inking roller 2 and the plate cylinder 1 and to feed the inking roller 2 towards and away from the plate cylinder 1.

Additionally, the metering roller 4 could be moved by the one-armed lever 20 into an inclined position relatively to the axis of the damping fluid fountain roller 3 by conventional means known in the art.

Figure 3:
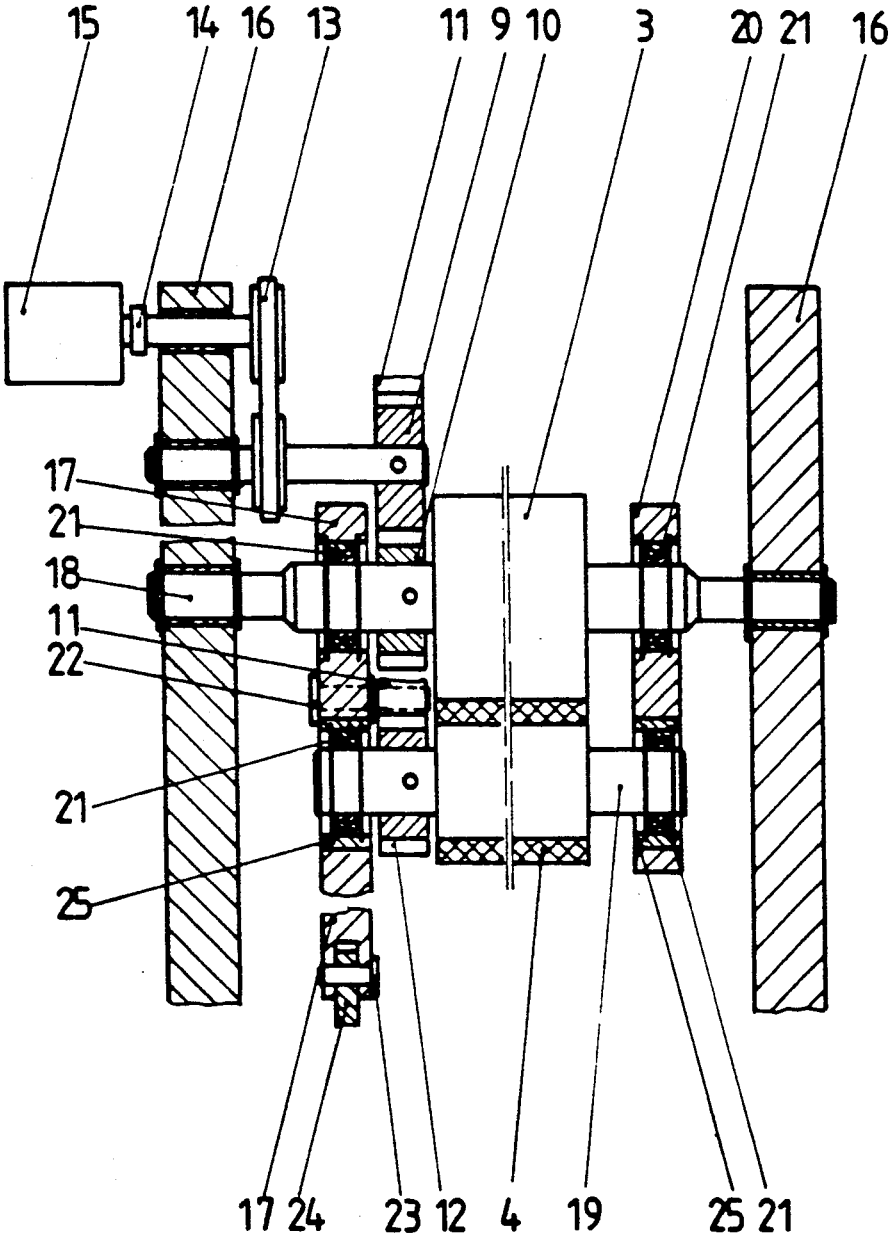
FIG. 3 is a top plan view of the damping unit of FIG. 1 and in a simplified and partly sectional view.

Pursuant to the primary features of the invention, a second intermediate gear 11 is rotatably mounted with the interposition of a bearing pin 22 in the lever 17 rotatable about the journal 18 of the damping fluid fountain roller 3 and meshes both with a driven gear 12 secured to the journal 19 of the metering roller 4 and with a first intermediate gear 9 as shown in FIGS. 1 and 3. The first intermediate gear 9 meshes with a first driven gear 10 on the fountain roller 3 and is drivingly connected by way of belt drive 13 and a clutch 14 to a variable-speed geared motor 15.

In the illustrated embodiment, the positive drive of the rollers 3 and 4 by means of the gears 9–12 can be brought into and out of operation by the meshing of the two intermediate gears 9 and 11 being interrupted and restored by the lever 17 being pivoted around the journal 18 of the roller 3 with a gap "S" as shown in FIG. 2. The lever 17 is pivoted around the fountain roller journal 18 by means of an actuating cylinder 24 pivoted by way of a fulcrum 26 pinned to the side walls 16 of the press. The piston of actuator 24 is received by means of a pin 23 on the forked end of the lever 17 illustrated in FIGS. 1–3.

The journals 18 and 19 of the respective rollers 3 and 4 are rotatably mounted in bearings 21 in the respective levers 17 and 20. An eccentric lining 25 serves to adjust the between-axes spacing of the rollers 3, 4 and is disposed on one of the two roller spindles.

In accordance with the invention, when the damping fluid is being applied, all the rollers rotate in the direction indicated by the closed arrow heads shown in FIG. 2, the slip between the fountain or ductor roller 3 and the metering roller 4 being unequivocally determined by four meshing gears 9 to 12 in accordance with the selected transmission ratio. In this position the device operates as a damping unit.

Pursuant to the invention, when the positive drive is selectively disengaged by the meshing of the intermediate gears 9, 11 being interrupted as the result of the lever 17 pivoting around the fountain roller journal 18, the rollers still rotate in the direction of the solid-line arrow heads but the metering roller 4 is now driven frictionally by the damping fountain or ductor roller 3 as shown in FIG. 2. This position is very suitable as a washing position since the rollers of the inking unit and damping unit can be washed together without a positive drive. All the rollers of the inking unit and damping unit remain in contact with one another. Additionally, this position is also suitable for varnishing with the metering roller 4 either selectively engaged or disengaged.

From the foregoing it will be understood that the selective drive for a metering roller of a damping unit in an offset printing press enables the selective disengagement of the positive drive of the metering roller. The gear wheel drive of the metering roller is selectively brought out of operation by un-meshing two intermediate gears. In this connection, a lever, which carries the metering roller and one intermediate gear, is pivoted by an actuating cylinder around the axis of the damping unit fountain roller. In such disengaged position, the metering roller is frictionally driven by the damping fluid fountain roller which is particularly advantageous for simultaneously washing the rollers.

We claim as our invention:

1. A selective drive for a damping unit metering roller having a journal in an offset printing press having a damping fluid ductor roller having a journal which transfers damping fluid as a film to at least one inking roller in engagement with a printing plate on a plate cylinder of the printing press and wherein the thickness of the damping fluid is controlled by the engagement of the metering roller with the ductor roller, comprising in combination means including a pair of levers rotationally supporting the metering roller and mounted for pivotal movement around the axis of the ductor roller, means including a variable speed motor and clutch for driving the ductor roller and metering roller independently of the plate cylinder, said driving means also including a first driven gear secured to the journal of the ductor roller, a second driven gear secured to the journal of the metering roller, a first intermediate gear meshing with the first driven gear and being drivingly connected to the variable speed motor and clutch, and a second intermediate gear meshing with the second driven gear and being selectively engageable with and disengageable from the first intermediate gear to selectively drive the metering roller therefrom, and the metering roller being disposed for peripheral driving engagement by the ductor roller when the second intermediate gear is disengaged from the first intermediate gear.

2. The combination defined in claim 1 wherein the second intermediate gear is rotatably mounted on one of the levers mounted for pivotal movement around the axis of the ductor roller and including means for selectively pivoting the pair of levers around the axis of the ductor roller.

* * * * *